United States Patent [19]

Sundin

[11] Patent Number: 4,949,860

[45] Date of Patent: Aug. 21, 1990

[54] CONTAINER STORAGE APPARATUS

[76] Inventor: Scott B. Sundin, 45 South Rd., Holden, Mass. 01520

[21] Appl. No.: 359,980

[22] Filed: Jun. 1, 1989

[51] Int. Cl.[5] ..... B65D 6/08; B65D 6/18

[52] U.S. Cl. ..... 220/489

[58] Field of Search ..... 220/19; 217/31

[56] References Cited

U.S. PATENT DOCUMENTS

| | | | |
|---|---|---|---|
| 152,432 | 6/1874 | Strong | 217/31 |
| 1,179,845 | 4/1916 | Lange | 217/26 |
| 1,599,243 | 9/1926 | Parker | 220/19 |
| 1,719,583 | 7/1929 | Blaukowitcsh | 220/19 |
| 2,121,403 | 6/1938 | Lapinskas | 220/19 |
| 2,346,025 | 4/1944 | Guszmann | 217/31 |
| 2,790,556 | 4/1957 | Burt | 220/19 |
| 3,191,791 | 6/1965 | Jackson | 217/25.5 |
| 3,900,157 | 8/1975 | Roth . | |
| 4,235,364 | 12/1980 | Baker . | |
| 4,238,068 | 12/1980 | Ellerbe et al. . | |
| 4,511,079 | 4/1985 | Lopez . | |
| 4,702,408 | 10/1987 | Powlenko . | |

FOREIGN PATENT DOCUMENTS

| | | | |
|---|---|---|---|
| 587220 | 4/1925 | France | 220/19 |

*Primary Examiner*—George E. Lowrance
*Attorney, Agent, or Firm*—Leon Gilden

[57] ABSTRACT

A container storage apparatus is set forth wherein a series of stacked continuous loops overlie one another movably associated relative to one another by a series of link members with internal link members between interior loops defined by a central pivot opening with spaced terminal pivot openings pivotally associated with other aligned links terminating in external links of a length substantially half that of the main links to secure the main links to the exterior loops. Container inserts are positioned in a nested arrangement overlying one another to define compartments for storage of containers therein with the inserts and the apparatus interfoldable for storage during periods of non-use.

5 Claims, 1 Drawing Sheet

CONTAINER STORAGE APPARATUS

BACKGROUND OF THE INVENTION

1. Field of the Invention

The field of invention relates to storage containers, and more particularly pertains to a new and improved container storage apparatus wherein the same may be erected during periods of need and may be further collapsed for storage thereof.

2. Description of the Prior Art

Container storage devices have been utilized throughout the prior art for the storage of containers, and accordingly have been of a relatively fixed geometric configuration whether they have been filled with articles or not. For example, U.S. Pat. No. 4,235,364 to Baker sets forth a plurality of container blanks scored and perforated such that they may be utilized for development of a variety of containers therefrom of a generally parallelepiped construction.

U.S. Pat. No. 4,238,068 to Ellerbe, et al., sets forth a container with a self-locking closure and flaps for the storage of various container cans therein.

U.S. Pat. No. 4,511,079 to Lopez sets forth a one-piece collapsible paper-board container utilizing internal panels which may be folded in alternative positions to accommodate varying inner dimensions of containers positioned within the one-piece container storage.

U.S. Pat. No. 4,702,408 to Powlenko sets forth a storage bin utilizing a unitary sheet of corrugated paper board for development of an enclosing container about an article.

U.S. Pat. No. 3,900,157 to Roth sets forth a container storage wherein the structure is formed from a single flat sheet of material interfolded for development of a compartment with handle openings and rigid walls.

As such, it may be appreciated that there is a continuing need for a new and improved container storage apparatus wherein the same addresses both the problems of ease of use and compactness of construction during periods of non-use, and in this respect, the present invention substantially fulfills this need.

SUMMARY OF THE INVENTION

In view of the foregoing disadvantages inherent in the known types of container storage devices now present in the prior art, the present invention provides a container storage apparatus wherein the same may be erected or collapsed dependent upon use or storage of the instant invention with container dividing inserts positioned within various layers of containers oriented within the storage apparatus to maintain the apparatus in an erected configuration during periods of use. As such, the general purpose of the present invention, which will be described subsequently in greater detail, is to provide a new and improved container storage apparatus which has all the advantages of the prior art container storage devices and none of the disadvantages.

To attain this, the present invention comprises a container storage apparatus utilizing a series of equally configured overlying geometric tubular loops with the loops movably and collapsibly mounted relative to one another utilizing a series of main links pivotally mounted about each of the interior loops with an exterior link mounted to the outside of terminal loop members wherein each of the links includes a pivot connection medially of the loops and wherein each of the loops are also medially pivoted relative to a compartment defined by interconnected panels defining inserts to separate containers relative to one another and within layers relative to each of the loops. The inserts are each formed with channels at upper edges and tapered bottom edges receivable within respective top edges in a complementary manner to secure the inserts relative to one another, wherein the inserts are provided with notched legs to maintain the loops in an erected configuration.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container storage apparatus which has all the advantages of the prior art container storage devices and none of the disadvantages.

It is another object of the present invention to provide a new and improved container storage apparatus which may be easily and efficiently manufactured and marketed.

It is a further object of the present invention to provide a new and improved container storage apparatus which is of a durable and reliable construction.

An even further object of the present invention is to provide a new and improved container storage apparatus which is susceptible of a low cost of manufacture with regard to both materials and labor, and which accordingly is then susceptible of low prices of sale to the consuming public, thereby making such container storage apparatus economically available to the buying public.

Still yet another object of the present invention is to provide a new and improved container storage apparatus which provides in the apparatuses and methods of the prior art some of the advantages thereof, while simultaneously overcoming some of the disadvantages normally associated therewith.

Still another object of the present invention is to provide a new and improved container storage apparatus wherein the same includes a series of collapsible and extensible loops maintained in an extended or collapsed orientation relative to one another for the storage of containers therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
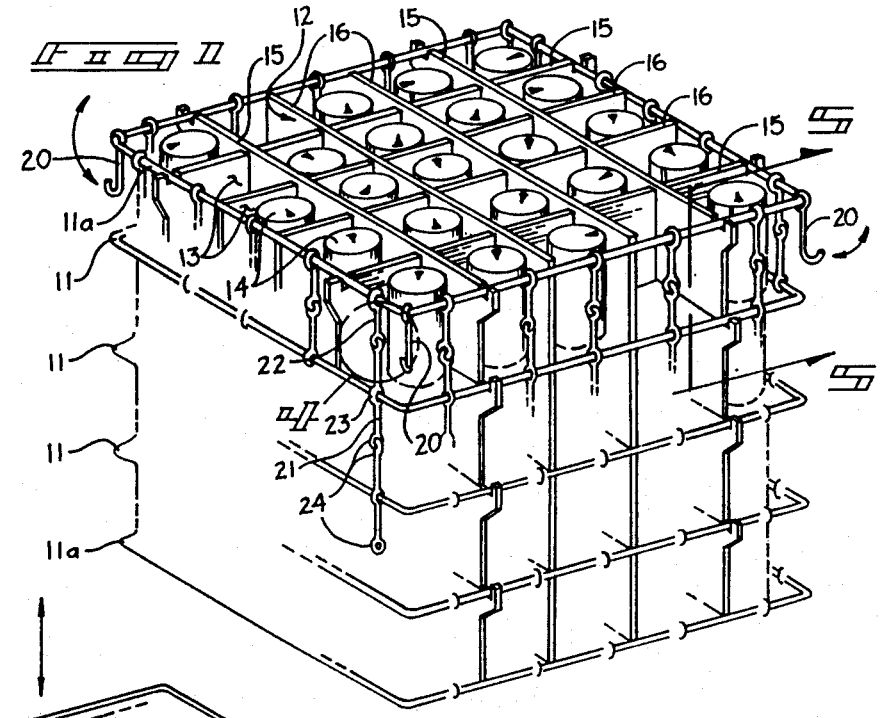
FIG. 1 is an isometric illustration of the instant invention.
Figure 2:
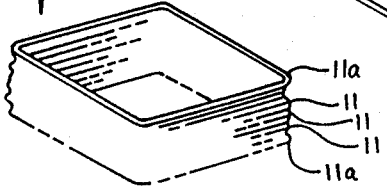
FIG. 2 is a diagrammatic illustration of the instant invention in a collapsed orientation.

With reference now to the drawings, and in particular to FIGS. 1 to 5 thereof, a new and improved container storage apparatus embodying the principles and concepts of the present invention and generally designated by the reference numeral 10 will be described.

More specifically, the container storage apparatus 10 of the instant invention essentially comprises a series of frame loops defined by an interior tubular series of framework portions 11 with a plurality of frame loops 11*a* positioned to define upper and lower terminal frame loops. The erected storage apparatus includes a series of container inserts 12 defined by orthogonally crossed panels to define compartments 13 to contain cylindrical containers 14. The panels are defined by exterior panels 14 with a plurality of interior panels 16. Each pair of exterior panels 14 include a notched leg 19 coextensively formed and positioned exteriorly of an associated frame loop with the notch portion of each leg for securement of the frame loop therewithin. Each of the panels includes a narrowed bottom edge 17 of a complementary configuration to a channel 18 formed at each top edge of each of the panels to thereby enable a nested and aligned relationship of the inserts 12 as they are positioned overlying one another to lock the inserts relative to one another and to the associated frame loops 11 and 11*a*. A series of container storage apparatus members 10 may be positioned overlying and stacked relative to one another and secured relative to one another by corner hooks 20 pivotally mounted to each corner of each top frame loop 11*a* to secure an overlying frame loop and associated storage apparatus in a stacked relationship.

Figure 3:
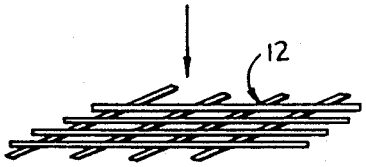
FIG. 3 is a top orthographic view of the container insert panels of the instant invention in a collapsed configuration.
Figure 4:
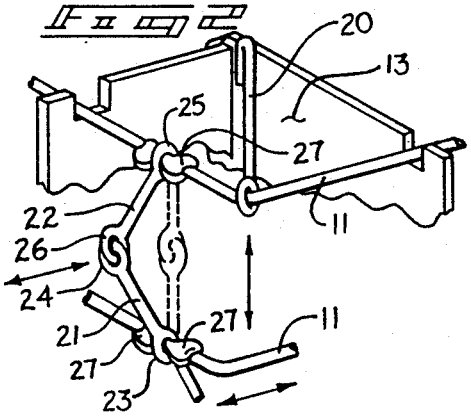
FIG. 4 is an isometric illustration of section 4, as set forth in FIG. 1.
Figure 5:
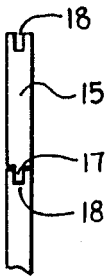
FIG. 5 is an orthographic view taken along the lines 5—5 of FIG. 1 in the direction indicated by the arrows.

Each of the interior tubular frames 11 includes a main link 21 with each of the top and bottom exterior frame loops 11*a* formed with an exterior link 22 of a length substantially half that of the main link 21. The main link 21 includes a central frame pivot opening 23 to rotatably receive a tubular frame therewithin and fixed between enlarged portions 27 of each loop. The central frame pivot opening 23 is positioned medially of terminal pivot openings 24 formed at terminal ends of legs of the main link 21. The terminal pivot openings 24 cooperate pivotally with subsequent terminal pivot openings 24 of adjacent main links. The exterior frame loops 11*a* are secured to the interior tubular frame loops 11 with an external link 22 formed with a frame pivot opening 25 with a single leg formed with a single terminal pivot opening 26 to cooperate with an adjoining terminal pivot opening 24 of a main link 21. Accordingly, it may be appreciated that the main links 21 and the external links 22 are aligned relative to one another and when in an erected configuration, are of a generally linear and orthogonal relationship relative to the tubular frame loops 11 and 11*a*. Upon removal of the container inserts 12 or subsequent to their insertion, the storage apparatus 10 may be in a collapsed configuration, as illustrated, wherein the main links 21 and the external links 22 are pivoted about their respective frame pivot openings 25 and central frame pivot openings 23 to enable the frame loops 11 and 11*a* to stack and reposition adjacent one another to enable storage thereof. FIG. 3 is illustrative of the container inserts 12 in a collapsed configuration upon removal from the storage apparatus 10 where it may be appreciated that a single container insert 12 is positioned between adjacent loops 11 and 11*a* and are of a height substantially equal to that of an associated container 14. Further, the lengths of each of the main links 21 are of a length substantially equal to that of a container 14 such that when in an extended configuration, as illustrated in FIG. 1, the compartments 13 thereby formed accommodate individual containers therein.

As to the manner of usage and operation of the instant invention, the same should be apparent from the above description, and accordingly no further discussion relative to the manner of usage and operation shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container storage apparatus for storage of elongate containers therein comprising, at least three frame loops of equal dimensional configuration, each including parallel sides, and wherein three frame loops define at least one intermediate frame loop with an overlying frame loop and an underlying frame loop, each of said frame loops aligned relative to one another when said apparatus is in an extended configuration, and a plurality of compartment container inserts, each positioned between adjacent frame loops, and pivoted link means pivotally mounted to each of said frame loops and to each other to secure said frame loops together, and said pivoted link means includes a plurality of main links pivotally mounted to said intermediate frame loop, each of said main links includes a central pivot opening medially of said main link and pivotally mounted about said intermediate loop with spaced terminal pivot openings formed at terminal ends of said main link, and said terminal pivot openings pivotally mounted to adjacent pivot openings of adjacent main links, and including external links pivotally mounted to each of said overlying and underlying frame loops and aligned with said main links and wherein each of said external links is of a length equal to half a length defined by each of the main links, and wherein each of the external links is formed with a single pivot opening pivotally formed to a respective overlying and underlying frame loop with a single terminal pivot opening pivotally secured to a terminal pivot opening of an aligned adjacent main link, and each of said container inserts includes plural pairs of interior and exterior panels orthogonally secured to further exterior and interior panels, and wherein each of said exterior panels is of a length greater than that defined by an associated frame loop, and wherein each of said interior panels is of a length substantially equal to that defined within an associated frame loop, and each of said exterior panels includes a notched leg, wherein each of the notches receive an associated frame loop therewithin.

2. A container storage apparatus as set forth in claim 1 wherein each of the panels includes a tapered bottom of a complementary configuration to a channel formed in a top edge of an underlying panel to enable interlocking of an overlying panel relative to an underlying panel.

3. A container storage apparatus as set forth in claim 2 wherein each of the links is oriented between an enlarged portion formed within each of the frame loops to maintain each of the links in a predetermined orientation relative to an associated frame loop.

4. A container storage apparatus as set forth in claim 3 wherein the overlying frame loop includes a hook at each intersection of each of the sides for securement to an overlying intermediate frame loop for securement of adjacent storage apparatus together in a stacked relationship.

5. A container storage apparatus as set forth in claim 4 wherein each of the container inserts is of a length substantially equal to that of an elongate container, and wherein each of the main links are of a length substantially equal to that of an associated elongate container.

* * * * *